US006039614A

United States Patent [19]

Ramari

[11] Patent Number: 6,039,614

[45] Date of Patent: Mar. 21, 2000

[54] FAST COUPLING AUTOMATIC LATCHING CONNECTOR RELEASABLE BY MOVEMENT OF AN EXTERNAL BODY

[76] Inventor: Luigi Ramari, Via A. Casati, 135-20043 Arcore, Italy

[21] Appl. No.: 08/905,925

[22] Filed: Aug. 5, 1997

[51] Int. Cl.[7] ..... H01R 13/00

[52] U.S. Cl. ..... 439/843; 439/846

[58] Field of Search ..... 439/843, 268, 439/846, 848, 842, 851, 824

[56] References Cited

U.S. PATENT DOCUMENTS

| | | | |
|---|---|---|---|
| 2,567,727 | 9/1951 | Quackenbush | 439/848 |
| 3,171,183 | 3/1965 | Johnston | 439/824 |
| 3,538,486 | 11/1970 | Schlesinger . | |
| 3,569,903 | 3/1971 | Brishka | 439/268 |
| 4,632,121 | 12/1986 | Johnson et al. | 128/639 |
| 5,024,608 | 6/1991 | Heng et al. | 439/578 |
| 5,332,394 | 7/1994 | Frost | 439/846 |

FOREIGN PATENT DOCUMENTS

| | | |
|---|---|---|
| 1284586 | 7/1962 | France . |
| 2082873 | 12/1971 | France . |

*Primary Examiner*—Paula Bradley
*Assistant Examiner*—Tho D. Ta
*Attorney, Agent, or Firm*—Collen Law Associates, P.C.

[57] ABSTRACT

The connector comprises a female element (12), a male element (14) and a body (16). The female element, made of conductive metal sheet or pipe, has a portion formed by fingers (21) having a certain degree of elasticity, which are normally spread apart when no external forces are applied. The fingers have retaining teeth (28) extending inwards. The male element has a shoulder surface (38) for engagement by the teeth of the female element. One element, male or female, holds the plug, and the other element, female or male, holds the socket. The body has a housing for the female element, comprising first and second communicating chambers, the first chamber housing the female element in a spread apart condition, and the second chamber housing the female element in a narrow, forced condition. Insertion of the male element with the shoulder surface thereof beyond the retaining teeth automatically locks the male element and the female element in a connected or wired position. Disconnection or release may only be carried out by sliding the body along the female element so that the latter occupies the widened chamber and can spread apart therein, disengaging the teeth from the shoulder surface of the male element which can therefore be extracted.

11 Claims, 2 Drawing Sheets

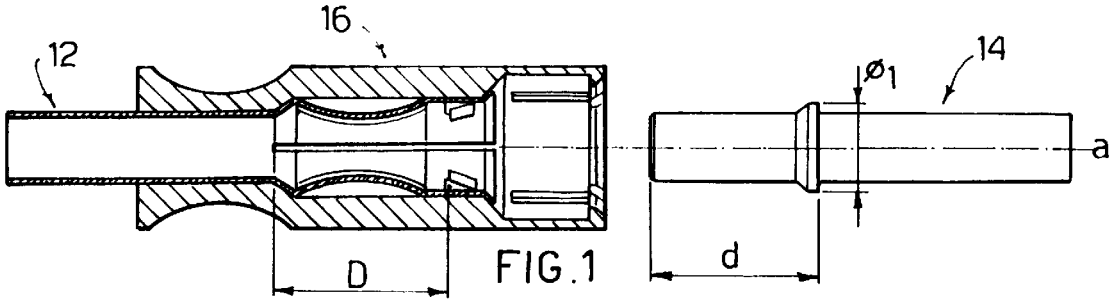
FIG.1
FIG.3
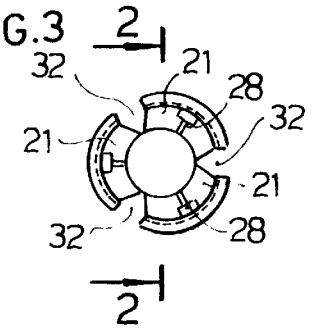
FIG.2
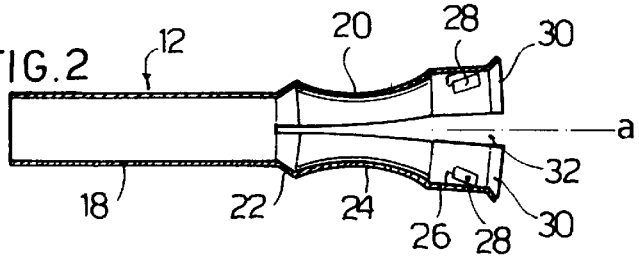
FIG.5
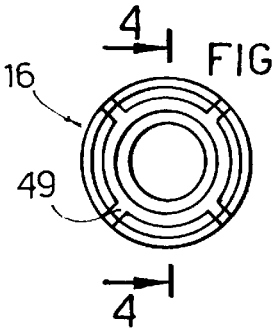
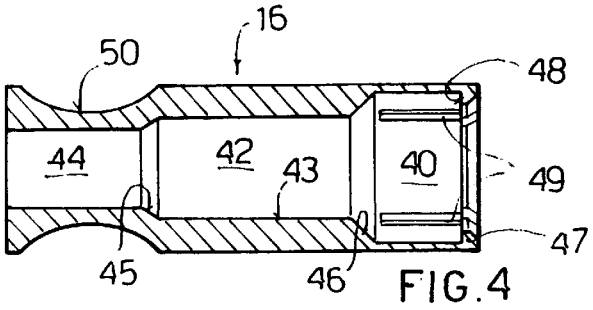
FIG.4
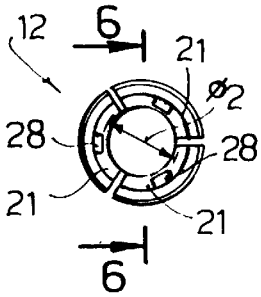
FIG.7
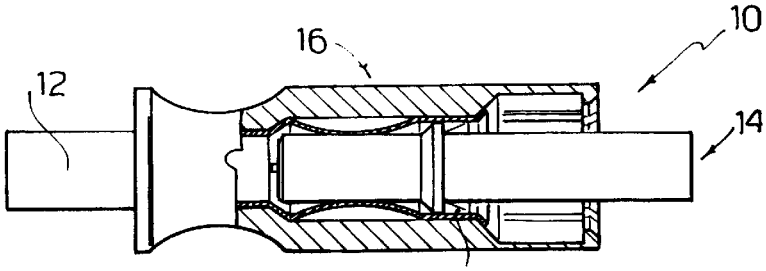
FIG.6
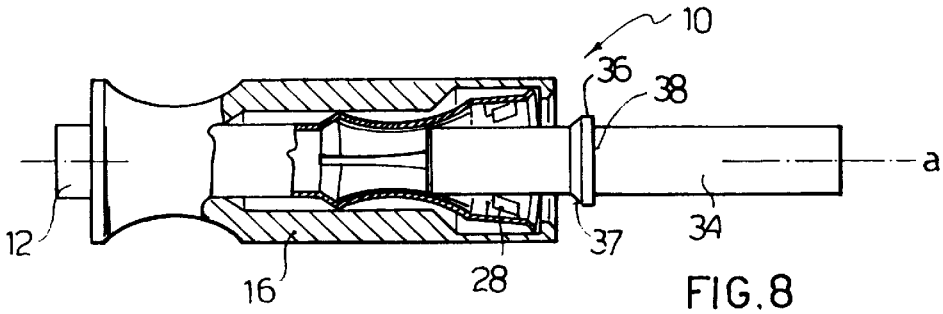
FIG.8

FAST COUPLING AUTOMATIC LATCHING CONNECTOR RELEASABLE BY MOVEMENT OF AN EXTERNAL BODY

FIELD OF THE INVENTION

The invention relates to a fast coupling or quick-coupling connector fitted with a sliding safety sleeve or body, which prevents accidental release thereof. The connector is particularly suitable for monopole or multipolar screened/shielded cables. In general connectors of this type are commonly used for radio aerials, telephony etc. In these fields the need is felt for a connector which allows the electrical connection of two parts simply by a fast and easy operation of moving together, and which nevertheless does not allow the two parts to separate except through a deliberate action by the user.

BACKGROUND OF THE INVENTION

Various types of quick coupling connectors have been tried hitherto which are releasable through the sliding of an external element. Some comprise a ball locking system, others have projecting elements and cavities which can engage with one another only in certain positions.

All of them comprise a considerable number of parts, making their production cost relatively high.

The need to provide increasingly efficient connectors at a lower cost is thus felt in the field.

The aim of the present invention is to avoid the disadvantages of the prior art and achieve the aims specified above.

SUMMARY AND OBJECTS OF THE INVENTION

The aims have been achieved with a connector as claimed in claim 1. Further new and advantageous features are stated in the dependent claims.

The connector comprises a female element, a male element and a body.

The female element, made of conductive metal sheet or pipe, has a portion formed by fins or fingers having a certain elasticity, normally spread apart when no external forces are applied. The fingers have retaining teeth extending inwards. The male element has a shoulder surface for engagement of the teeth of the female element. Where necessary, for coaxial or multipolar connectors, one element, male or female, may contain internally one or more plugs and vice versa the other element, female or male, can carry the respective sockets.

The body has a housing for the female element, comprising a first and a second communicating chambers, the first chamber being able to house the female element in a widened or spread apart condition and the second chamber housing the female element in a narrow, forced condition. Insertion of the male element with the shoulder surface beyond the retaining teeth automatically locks the male element and the female element in a connected or wired position. Release or disconnection may only be achieved by sliding the body along the female element in such a way that the latter occupies the wide or second chamber and may spread therein, releasing the engagement of the teeth from the shoulder surface of the male element which can therefore be extracted.

The new connector overcomes the drawbacks of the prior art, comprises a reduced number of parts, can be produced at low cost and is convenient to use; moreover, once it has been locked up, it ensures contact pressure between the male and female elements; this contact pressure between the male and female elements is particularly effective with the connector in the inserted condition and may be eliminated in the unlocked position.

The new connector is suitable for use with shielded cables.

BRIEF DESCRIPTION OF THE DRAWINGS

FIG. 1 is a longitudinal sectional view, taken on an axial plane, of a first embodiment of a connector according to the invention, shown in a condition before connection or coupling of the male element and the female element;

FIG. 2 is an axial longitudinal sectional view, along 2—2 in FIG. 3, of only the female element of the connector in a spread apart, unstressed condition;

FIG. 3 is a view of the female element of the connector from the right in FIG. 2;

FIG. 4 is an axial sectional view of the body element of the connector taken along plane 4—4 in FIG. 5;

FIG. 5 is a view from the right of the body of the connector;

FIG. 6 is an axial sectional view of the connector shown in a connected locked condition, along plane 6—6 in FIG. 7;

FIG. 7 is a right end view of the female element in a contracted condition;

FIG. 8 is an axial sectional view of the connector shown in a released condition, wherein the male element can be extracted from the female element;

DETAILED DESCRIPTION OF THE PREFERRED EMBODIMENTS

Figure 9:
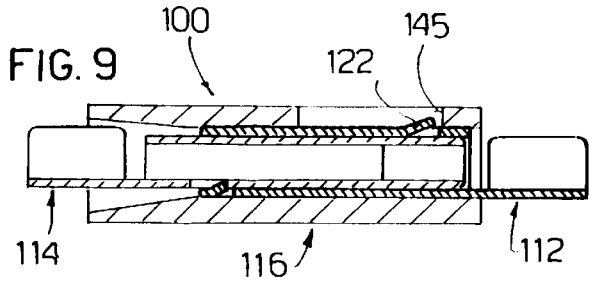
FIG. 9 is a sectional view, taken along a longitudinal median plane 9—9 in FIG. 18, of a second embodiment of connector in an engaged, locked condition.
Figure 10:
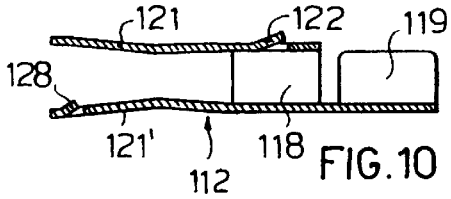
FIG. 10 is a sectional view, taken along a longitudinal median plane 10—10 in FIG. 11, of the female element of the connector of FIG. 9, in a spread apart, non-forced condition.
Figure 11:
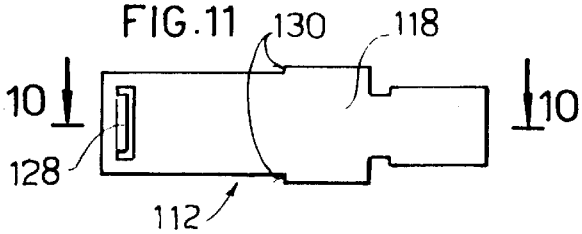
FIG. 11 is a bottom plan view in respect of FIG. 10.
Figure 12:
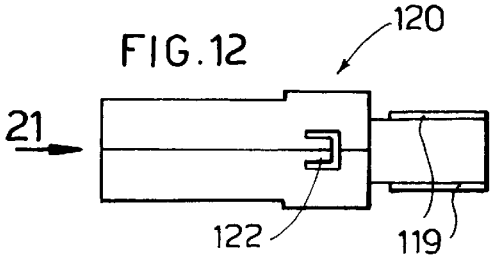
FIG. 12 is a top plan view in respect of FIG. 10.
Figure 13:
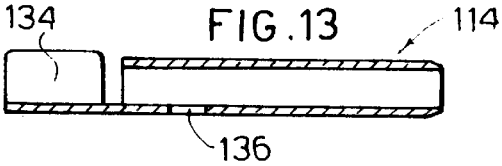
FIG. 13 is a longitudinal sectional view of the male element of the embodiment of FIG. 9.
Figure 14:
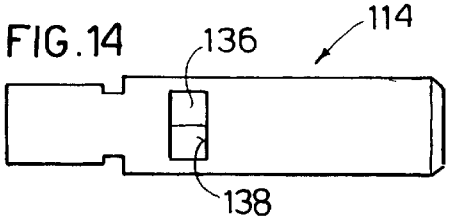
FIG. 14 is a bottom plan view in respect of FIG. 13.
Figure 15:
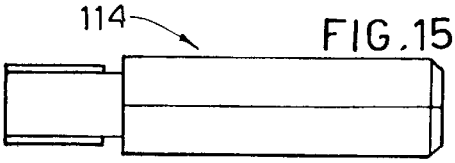
FIG. 15 is a top plan view in respect of FIG. 13.
Figure 17:
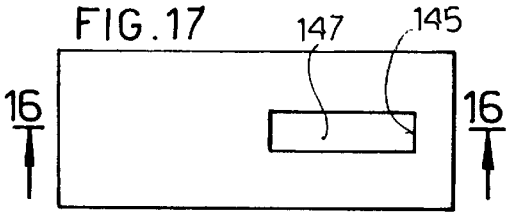
FIG. 17 is a top view in respect of FIG. 16.
Figure 16:
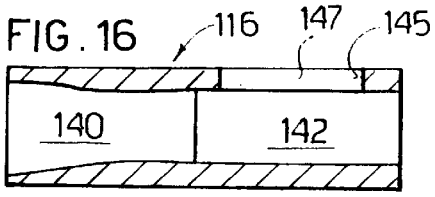
FIG. 16 is a longitudinal median sectional view of the body element, along 16—16 in FIG. 17.
Figure 19:
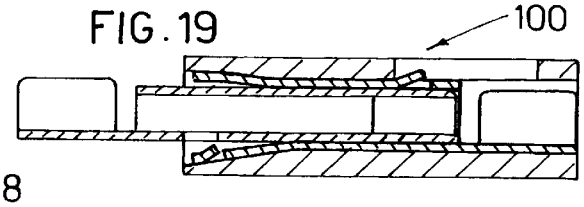
FIG. 19 is a longitudinal median sectional view of the connector of FIG. 9, shown in the released condition, wherein it is possible to extract the male element from the female element; the sectional view is taken along a plane 19—19 in FIG. 20.
Figure 18:
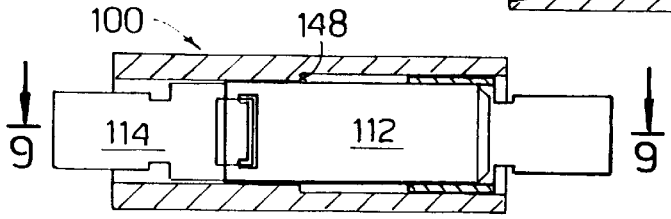
FIG. 18 is a bottom view in respect of FIG. 9, with a lower wall of the body removed.

Referring first to FIGS. 1 to 8, the following is a description of a first embodiment of the connector, which is denoted overall by reference numeral 10.

The connector 10 comprises a female element 12, a male element 14 and a sleeve or body element 16. Generally the male and female elements are made of a conductive material, and the body can be made of metal or plastic. By using coaxial or in any case multipolar screened (shielded) cables, additional electrical connection means, generally comprising plugs and sockets, may be placed some internally integral with the female element 12 and others internally integral with the male element 14, and are not shown in the accompanying drawings. Likewise electric cables joined to the male element and to the female element are not shown.

The female element 12, as shown in greater detail in FIGS. 2 and 3, comprises a tubular part made of conductive wound sheet or pipe and a retaining part 20 having fins or fingers integral with the tubular part 18. The fingers 21 of the part 20 may be two or more, preferably, in the embodiment shown, three identical fingers are evenly arranged around the central longitudinal axis a of the female element. Each fin or finger preferably has a shape with a slanting surface 22 adjacent to the tubular part 18, a curved surface 24 which ensures the necessary contact pressure, with the connector in inserted condition, and a surface portion 26 from which a retaining tooth 28 projects inwards. Generally there is only one retaining tooth 28 for each finger, but there may be more on each one. The retaining tooth is preferably obtained by punch-cutting three sides thereof out of a sheet which makes up the finger, the fourth side remaining joined to act as a hinge for the tooth. At the distal end of the female element, the part 20 with fingers has on each finger an end surface widening outwards and referenced 30. The wings are separated by slots denoted by 32, preferably extending as far as the root of the fingers, where they are joined to the tubular part 18. The material whereof the female element is composed (generally conductive sheet metal) is sufficiently elastic for the fingers, in a condition with no external forces, to have an outwardly widened or spread apart position, as shown in FIGS. 2 and 3.

The male element, in the embodiment of said figures, consists of a substantially cylindrical body 34, with an annular projection 36 projecting from the body. The projection preferably has a frustoconical surface 37 towards the end of the male element intended to be housed in the female element, and a retaining surface 38 or retaining shoulder, opposite the surface 37. The distance d between the end of the male element intended to be housed in the female element and the surface 38 is not greater than the distance D between the end of the teeth of the female element and the root of the fingers, or joining surface of the fingers and the tubular part.

The body element or sleeve 16 is formed with an internal axial through housing which comprises three communicating chambers, referenced 40, 42 and 44 respectively. The chamber 44 has such a diameter as to be able to house the tubular part 18 of the female element. The chamber 42 has such internal dimensions as to be able to house the part 20 of the female element in a contracted or tightened condition. The chamber 40 has such a diameter as to be able to house the part 28 of the fingers of the female element in the spread apart condition. A frustoconical surface 45 between the chambers 42, 44 is intended to house and support the surface 22 of the female element. A frustoconical surface 46 between the chamber 40 and the chamber 42 is intended to house and support the surface 30 of the fingers in a contracted condition. A shoulder surface 48 on an internal projecting part 47 of the distal end of the body 16, towards the interior of same, is intended to provide an abutment for the limit position of the body in respect of the female element, so that the latter cannot be disengaged accidentally therefrom. Longitudinal slots 49 in the chamber 40 are provided to allow the body element to disengage from the manufacturing mould during manufacture thereof. A peripheral groove 50 can be provided externally on the body to allow the user to grip it easily with his fingers.

The female element 12 is assembled to the body element 16 by inserting from the end shown on the right in the drawings and then by pushing it as far as the position illustrated in FIG. 1, wherein the surface 22 of the fingers is placed against the surface 45 of the body, and the portion 26 of the fingers is placed against the surface 43 of the chamber 42, which forces the fingers into a closed or gathered position. With the female element/body element assembly in the condition illustrated in FIG. 1 and described here, the male element 14 can be connected easily and simply by bringing the assembly 12, 16 and the male element 14 close one to the other along the axis a and inserting the male element in the assembly 12, 16. The male element, by entering with the annular projection 36, elastically pushes the teeth 28 outwards until the projection 36 goes beyond the teeth themselves, which then spring into their extended position engaging the shoulder surface 38 and preventing extraction of the male element 14. An identical result can be obtained if the element 12 is inserted in the element 16 in such a way that the part 30 goes beyond the shoulder 48 (FIG. 8), and the male element 14 is inserted as shown in FIG. 8. During insertion, by holding the male part 14 by the right hand and the body 16 by the left, and exerting a reciprocal pressure, the three elements will be assembled in a non-detachable manner as shown in FIG. 6, more specifically a reciprocal pull applied on the element 14 and element 12, or on cables connected thereto, does not cause release of the connection. In order to achieve disengaging or release, the body element 16 has to be made to slide along the axis a in respect of the female element 12, in the position shown in FIG. 8. That is to say the operator holds the element 14 in one hand and pulls, with the other hand, the body element 16 to the left in the drawings. This manoeuvre means that the part 28 of the fingers of the female element occupies the larger diameter chamber 40, of the body, so that the fingers spread apart elastically to an adequate extent for the teeth to disengage the shoulder 38 of the male element, which can therefore be removed from the female element. The reciprocal position of the female element and of the body has a limit in the reciprocal engaging of the distal end 30 of the fingers and of the shoulder surface 48 of the body. Clearly the maximum diameter Ø1 of the annular projection 36 of the male element must not be greater than the diameter Ø2 defined by the innermost ends of the teeth 28 of the female element, in a non-forced condition of the teeth 28 and of the fingers 21.

As mentioned previously, the shown embodiment may entail a number of variants, for example instead of three there may be two or four fingers, or as required.

Referring to FIGS. 9 to 20, another embodiment of the invention will now be described, denoted overall by the reference numeral 100.

The connector 100 comprises a female element 112, a male element 114 and a locking sleeve or body element 116. The female element 112 in conductive metal sheet is in this case formed with a tubular part 118 with a quadrangular section, and if necessary a part with deformable tongues 119, which may be clipped onto the cable. The female element also comprises a part 120 having fingers, in this case formed by two elastically deformable and facing flat fingers 121, 121', the finger 121' having an elastic tooth 128 protruding towards the other finger. The fingers 121, 121' are joined to the tubular section 118. The tooth 128 is preferably formed by punch cutting in the finger 121'. An elastic stop tooth 122 is formed in the tubular portion 118 and extends outwards. The width of the tubular portion extends slightly beyond the width of the fingers to form shoulder surfaces 130.

The male element 114 is preferably also formed from bent metal sheet, in this case with a quadrangular section, and comprises distal tongues 134 for crimping to a cable and a tubular part, in one of whose walls an aperture 136 is made to form a shoulder surface 138.

Figure 20:
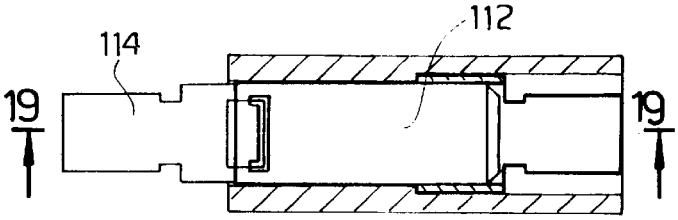
FIG. 20 is a bottom view of FIG. 19, with a lower wall of the body element removed.
Figure 21:
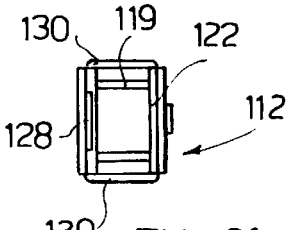
FIG. 21 is an end view of FIG. 12.

The body 116 in this embodiment has a substantially rectangular form viewed from the ends and a through hole or through longitudinal housing therein comprises consecutive chambers 140, 142 whereof the chamber 140 houses the distal ends of the fingers of the female element in a spread apart condition, and the chamber 142 houses the fingers in the retracted and contracted condition. In this embodiment, abutment surfaces 148 for preventing extraction and accidental disengaging of the female element from the body are formed between the chambers 140 and 142, and are intended for being engaged by the shoulders 130 of the female element, as can be seen in FIG. 20. One wall of the body has a longitudinally elongated aperture 147, one of whose walls 145 co-operates with the tooth 122 to prevent extraction from the body 116 of the female element 112 to the right in the drawings. The female element is assembled to the body by inserting it, with the fingers contracted, via the right-hand end until the surfaces 130, 148 engage one with the other. With the female element in the condition of FIG. 19, that is to say with spread apart fingers, the male element is inserted and the tooth 128 engages against the shoulder 138, when the fingers move into the adjacent or contracted position, so as to lock the male element inside the female element (FIG. 9). Extraction can only take place after sliding of the body element 116 in respect of the female element 112 from the position of FIGS. 9 and 18 to the position of FIGS. 19 and 20, wherein the fingers 121, 121' spread apart, leaving the male element free.

It should be noted that the plastic body, particularly in the second embodiment, may be moulded or made in any way in a multiple form, to house similar contacts or contacts with different features.

As a variant on what has been described previously, provision is also made for the retaining teeth 28 or 128, instead of being formed by punching in the finger and hence elastic, to be formed for example by drawing in the material of the finger and hence rigid therewith. In this case coupling of the male and female elements is only possible by starting from the positions of FIGS. 8 and 19.

According to a further variant, the male and female elements may have a polygonal section instead of a rectangular or circular one.

The shape of the male and female elements contributes to forming complete screening using monopole or multipolar screened cables.

While specific embodiments of the invention have been shown and described in detail to illustrate the application of the principles of the invention, it will be understood that the invention may be embodied otherwise without departing from such principles.

I claim:

1. A fast coupling connector assembly for connection of electric cables of a type comprising a male element and a female element engageable one with the other and a body element or sleeve which houses both the male element and the female element in an engaged position, the body element being slidable for a length on the female element between a locking position, wherein it locks the male element and female element in the engaged position, and a release position wherein it allows release of the male element and female element, retaining means being provided to restrain the male element and the female element in the position wherein they are engaged one with the other, wherein said female element comprises a retaining part with elastic fingers which, in a non-deformed condition, not forced, are spread apart, at least one of said fingers having a retaining tooth towards an interior of the female element, said retaining tooth/teeth forming said retaining means, said male element comprises a shoulder surface for co-operating, in the engaged position, with said retaining means of the female element, said body element is configured with an internal housing which comprises at least a first chamber, shaped with dimensions such as to house the retaining part of the female element in a contracted condition with the fingers close one to the other.

2. A connector assembly according to claim 1, wherein said retaining tooth/teeth is/are elastically flexible.

3. A connector assembly according to claim 1, wherein the fingers of the female element exert a contact pressure on the male element only when the two male and female elements are completely inserted with the body element in a locking position, and this contact pressure is non-existent in the release position.

4. A connector assembly according to claim 1, suitable for forming complete screening using monopolar or multipolar screened cables.

5. A connector assembly according to claim 1, wherein the body element has at least one second chamber longitudinally adjacent and communicating with the first chamber, said second chamber having adequate dimensions for housing the retaining part with the lingers spread apart.

6. A connector assembly according to claim 3, wherein the body element has a retaining surface adjacent to said second chamber of greater diameter, and the female element comprises a widened end surface, both intended to co-operate to prevent accidental extraction of the female element from the body.

7. A connector assembly according to claim 1, wherein the male element has a cylindrical body, and said retaining surface or shoulder is formed on an annular projection of the cylindrical body; said female element comprises a tubular part for connection to the cables, integral with said part having fingers; a distance between the shoulder surface of male element and an end of the male element intended to be housed in the female element is not greater than a distance between any one of the ends of the teeth of the female element and a root of the retaining part with fingers of the female element, the body element having said first chamber with a substantially circular shape.

8. A connector assembly according to claim 2, wherein an external diameter of the annular projection on the male element is not greater than an internal diameter defined by any one of the innermost surfaces of the retaining teeth in a non-forced condition of said teeth and said fingers.

9. A connector assembly according to claim 1, wherein the male element consists of a metal sheet bent into the shape of a tube with a polygonal section, the female element is in metal sheet with two facing fingers, and the body element has substantially polygonal cross sections.

10. A connector assembly according to claim 9, wherein the male element has a part with tongues for engaging a cable by crimping and said retaining surface is the edge of an aperture in the metal sheet.

11. A connector assembly according to claim 6, wherein the connector assembly is comprised of co-operating surfaces to prevent extraction of the female element from the body; said cooperating surfaces comprise one or more of the following: a surface on an elastic tooth extending from the female element and a surface on one side of a through aperture of the body; a shoulder surface on the female element and a facing shoulder surface in the housing of the body.

* * * * *